US006906274B2

(12) United States Patent
Ito et al.

(10) Patent No.: US 6,906,274 B2
(45) Date of Patent: Jun. 14, 2005

(54) MOVABLE CONTACT UNIT HAVING PRESS-DOWN PROJECTIONS

(75) Inventors: Masahiro Ito, Okayama (JP); Naoki Sera, Okayama (JP); Nobuhiro Numoto, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/700,680

(22) Filed: Nov. 5, 2003

(65) Prior Publication Data

US 2004/0129548 A1 Jul. 8, 2004

(30) Foreign Application Priority Data

Dec. 13, 2002 (JP) ..... 2002-362038

(51) Int. Cl.[7] ..... H01H 1/02; H01H 13/702
(52) U.S. Cl. ..... 200/512; 200/341; 200/345
(58) Field of Search ..... 200/512–517, 200/341–345; 400/490–495; 428/910, 913, 425.2

(56) References Cited

U.S. PATENT DOCUMENTS 5,888,656 A * 3/1999 Suzuki et al. ..... 428/425.5
6,084,190 A * 7/2000 Kenmochi ..... 200/341
6,224,278 B1 * 5/2001 Nishi ..... 400/495
6,604,278 B2 * 8/2003 Sera et al. ..... 29/622
6,723,936 B2 * 4/2004 Ootsuka et al. ..... 200/517

FOREIGN PATENT DOCUMENTS

JP 2002-216582 8/2002

* cited by examiner

*Primary Examiner*—James R. Scott
(74) *Attorney, Agent, or Firm*—Wenderoth, Lind & Ponack, L.L.P.

(57) ABSTRACT

Movable contact unit of the present invention comprises a plurality of dome-like movable contacts made of electrically conductive metal sheets capable of making an inflective action when depressed, a base film having an adhesive layer for retaining upper surfaces of the plurality of movable contacts, and a plurality of press-down projections bonded by adhesive to an upper surface of the base film in positions corresponding to center portions of the respective movable contacts, wherein the upper surface of the base film and underside surfaces of the press-down projections are each provided with a pretreated layer. The above structure has an advantage of strengthening the bonding between the adhesive and each of the pretreated layers formed on the adhering surfaces of the base film and the press-down projections, so as to provide the movable contact unit with outstanding reliability in maintaining the bonded condition for a long duration.

9 Claims, 5 Drawing Sheets

MOVABLE CONTACT UNIT HAVING PRESS-DOWN PROJECTIONS

TECHNICAL FIELD

The present invention relates to a movable contact unit provided with press-down projections used in a control panel and the like of a variety of electronic apparatuses.

BACKGROUND OF THE INVENTION

With the increase in variety of electronic apparatuses for portable use such as cellular phones, portable audio-video equipment, and the like in recent years, there is continued advancement in multi-functional capability as well as reduction in size, thickness and weight. Movable contact units of a type having a plurality of movable contacts retained on an insulating plastic film are used in large number as switches for control panels of the electronic apparatuses, as they can be made thin, and provide good tactile response as well as stable electrical contact. The movable contacts are made of electrically conductive metal sheets formed into a dome-like shape.

Since these apparatuses are being carried and used anywhere, the switches are operated so frequently that they require movable contact units of high durability and stable tactile response in the switching operation.

Referring now to FIG. 7, a description is provided hereinafter of a conventional movable contact unit of such kind used for the switch of a control panel.

In the conventional movable contact unit, as shown in FIG. 7, a plurality of dome-like movable contacts 3 are arranged independently with respect to one another, with their upper surfaces retained by adhesion of adhesive layer 2 formed on an underside surface of flexible insulating base film 1 having an external shape formed into a predetermined shape.

Movable contacts 3 are sandwiched between separator 4 made of an insulating film having a surface treated with release agent and base film 1. Separator 4 is held adhered to adhesive layer 2 on base film 1 in a manner that it covers the entire underside surface of base film 1.

As separator 4 is placed in close adhesion to base film 1 in a manner to completely cover the outer peripheries of movable contacts 3, it prevents corrosion of movable contacts 3. In addition, separator 4 also prevents adhesive layer 2 on base film 1 from sticking to other surfaces and gathering foreign objects unintendedly during transportation and in the storage.

The conventional movable contact unit further has small cylindrical parts 5A, which are fabricated by die-cutting a plastic film into a cylindrical shape, and bonded to base film 1 by adhesive resin 5B composed of epoxy acrylate, i.e. a kind of resin curable by ultraviolet rays. Each of cylindrical parts 5A and adhesive resin 5B compose press-down projection 5.

FIG. 8 shows a structure of the conventional movable contact unit in the actual application. After separator 4 is peeled off, base film 1 bearing movable contacts 3 is attached to wiring board 7 using adhesive layer 2 so that movable contacts 3 are aligned in a manner to face with their respective sets of stationary contacts 6 (6A and 6B).

FIG. 8 depicts wiring board 7 with the movable contact unit attached to it. The center portion of movable contact 3 confronts the respective one of central stationary contacts 6A, and the peripheral edge of movable contact 3 lies on the corresponding outer stationary contact 6B, so that each movable contact 3 and the corresponding stationary contacts 6 compose a single switch. In addition, actuator button 8 of the apparatus is arranged above press-down projection 5.

A switch for control panel using the conventional movable contact unit constructed as above operates in a manner which will be described now with reference to FIG. 9.

When actuator button 8 is depressed in a direction shown by an arrow in FIG. 9, the depressing force is given on the upper surface of cylindrical press-down projection 5, which is in contact to underside surface 8A of actuator button 8. The depressing force is thus applied to the center portion of movable contact 3 through press-down projection 5 and base film 1.

When the depressing force exceeds an inflectional strength of movable contact 3 of the dome-like shape, it bends into an inverted shape with a click-feeling, and an underside surface in the center of movable contact 3 comes in contact with central stationary contact 6A. This makes an electrical connection between central stationary contact 6A and outer stationary contact 6B on wiring board 7 via movable contact 3.

When the depressing force is removed, movable contact 3 regains its original shape by an elastic restoring force of its own. This separates the underside surface in the center of movable contact 3 from central stationary contact 6A, to restore the state of electrical isolation between the central stationary contact 6A and the outer stationary contact 6B of wiring board 7. By allowing the optimum click-feeling in the depressing operation, the above structure provides the control panel switch with good tactile response.

Due to the rapid-paced advancement in the multi-functional capability in addition to downsizing of portable apparatuses in the recent years, a number of functions assigned to a single switch increases, which consequently increases frequency of depressing operation of the switch. There is thus growing demand for improvement of durability to the switching operation.

In other words, the desire continues to increase for a movable contact unit designed to increase strength of adhesion of press-down projection 5 to base film 1 with steadiness of the tactile response even after repeated operations.

SUMMARY OF THE INVENTION

The present invention addresses the above problems, and it is intended to provide a movable contact unit having press-down projections which can maintain the press-down projections in a securely bonded condition to a base film without increasing a number of components used and necessitating a complicated manufacturing process.

To achieve the above object, the movable contact unit of this invention comprises a plurality of dome-like movable contacts made of electrically conductive metal sheets capable of making an inflective action when depressed, a base film having an adhesive layer for retaining upper surfaces of the plurality of movable contacts, and a plurality of press-down projections bonded by adhesive to an upper surface of the base film in positions corresponding to center portions of the respective movable contacts, wherein the upper surface of the base film and underside surfaces of the press-down projections are each provided with a pretreated layer. The above structure has an advantage of strengthening the bonding between the adhesive and each of the pretreated layers formed on the adhering surfaces of the base film and the press-down projections, so as to provide the movable contact unit with outstanding reliability in maintaining the bonded condition for a long duration.

DESCRIPTION OF THE INVENTION

Figure 1:
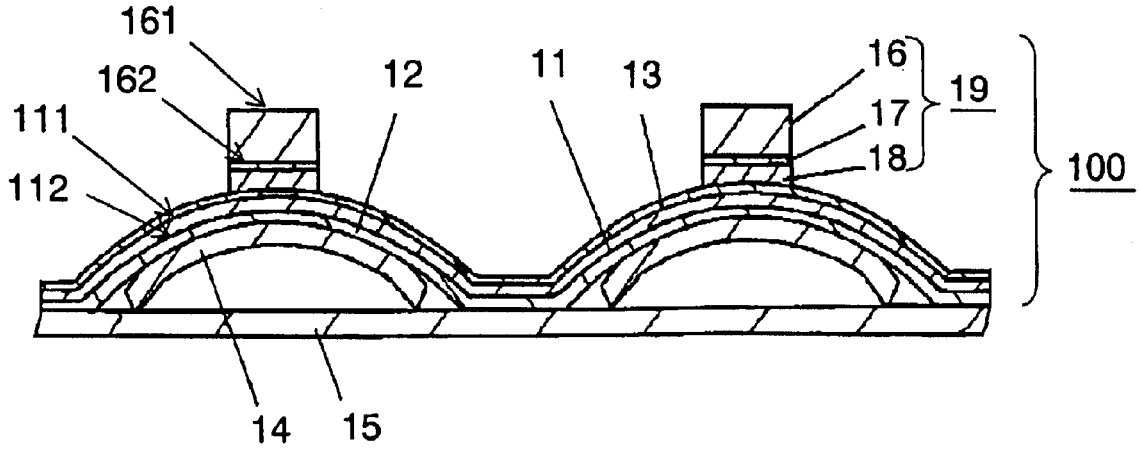
FIG. 1 is a sectioned front view of a movable contact unit with press-down projections according to an exemplary embodiment of the present invention.

Referring to FIG. 1 through FIG. 6, description is provided hereinafter of an exemplary embodiment of the present invention.

(Exemplary Embodiment)

Like reference numerals are used to denote like structural components as those described in the background techniques section, and their details will be skipped.

FIG. 1 shows movable contact unit 100 provided with press-down projections according to the present invention. As shown in FIG. 1, base film 11 composed of a flexible resin film. (made of PET) having an external shape formed into a predetermined shape has an underside surface (hereinafter referred to as first film surface) 112 and an upper surface (hereinafter referred to as second film surface) 111. Second film surface 111 is covered with a resin layer serving as a pretreated layer (hereinafter designated first pretreated layer) 13 formed by coating Ester resin.

Base film 11 has adhesive layer 12 covering an entire surface of first film surface 112, on which movable contacts 14 made of electrically conductive metal sheets formed into a dome-like shape are bonded securely. The plurality of movable contacts 14 are positioned independently with respect to one another into a predetermined layout, with their upper surfaces retained by adhesion. Movable contacts 14 positioned independently here means that they are not in contact with each other.

Base film 11 may be so prefabricated that portions corresponding to respective movable contacts 14 are convexed to fit the dome-like shape of movable contacts 14.

Separator 15 made of an insulating plastic film having a surface treated with agent is adhered to adhesive layer 12 to cover the entire area of first film surface 112 of base film 11 in the same manner as the related example, in order to prevent corrosion of movable contacts 14, gathering of foreign objects and the like.

In addition, small cylindrical parts (i.e. press-down members) 16 are bonded by adhesive resin 18 on their underside surfaces 162 to second film surface 111 of base film 11 in respective positions corresponding to the center portions of dome-like movable contacts 14, to thus compose press-down projections 19 of this exemplary embodiment of the invention. Each of small cylindrical parts 16 made of a PET film has resin layer (hereinafter designated second pretreated layer) 17 composed of Ester resin coated on its underside surface 162. Second pretreated layer 17 is bonded to base film 11 with adhesive resin 18. Accordingly, small cylindrical part 16, adhesive resin 18 and second pretreated layer 17 compose each of press-down projections 19. On the other hand, adhesive resin 18 bonds between second pretreated layer 17 on small cylindrical part 16 and first pretreated layer 13 on base film 11, since base film 11 has first pretreated layer 13 formed over second film surface 111. A main ingredient of adhesive resin 18 used in this exemplary embodiment is urethane acrylate, which is a kind of UV-curable resin.

What has been described above is the structure of movable contact unit 100 provided with a plurality of movable contacts 14, base film 11, and press-down projections 19 in order of the manufacturing process.

Figure 2:
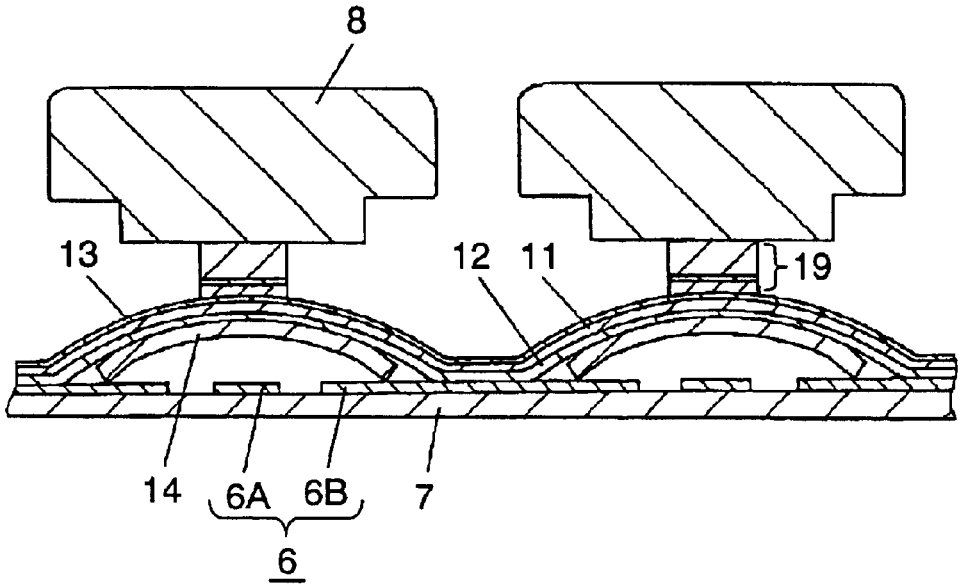
FIG. 2 is a sectioned view of a portion of a control panel switch provided with the movable contact unit according to the exemplary embodiment of this invention.

Next, FIG. 2 shows a control panel switch assembled with the movable contact unit having press-down projections according to this exemplary embodiment. Separator 15 is peeled off first from the movable contact unit having press-down projections, which bears separator 15 adhered to it as shown in FIG. 1. The movable contact unit is attached to wiring board 7 using adhesive layer 12 on the underside of base film 11, while movable contacts 14 are aligned over wiring board 7 having an array of stationary contacts 6 (6A and 6B), in a manner that movable contacts 14 face the corresponding sets of stationary contacts 6.

Here, each of movable contacts 14 is positioned with its peripheral edge lying on the outer stationary contact 6B so that the bottom center portion confronts the central stationary contacts 6A. Each of movable contacts 14 thus composes individual switch in combination with the corresponding stationary contacts 6.

Actuator buttons 8 of the apparatus are then arranged above press-down projections 19 in a corresponding manner. Accordingly, small cylindrical parts 16 come in contact with actuator buttons 8 at their upper surfaces 161.

Figure 3:
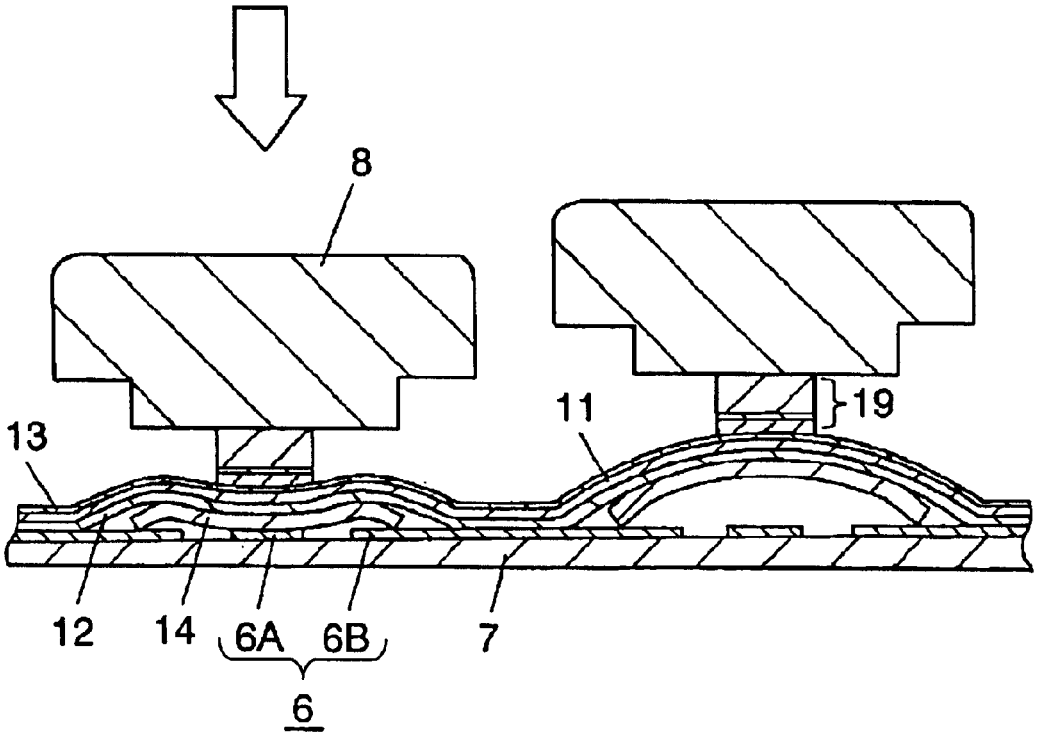
FIG. 3 is a drawing illustrating operation of the control panel switch shown in FIG. 2.

In the control panel switch of the above structure, depression of actuator button 8 in the direction of an arrow shown in FIG. 3 inflects movable contact 14 into an inverted shape, and causes the center portion of movable contact 14 lying on outer stationary contact 6B to come into contact with central stationary contact 6A, so as to make switching operation.

Evaluation

Description is given next of test methods and results of various comparison evaluations conducted on the movable contact unit having press-down projections according to this exemplary embodiment.

Describing first pertains to details of measurements made on a plurality of samples produced for bonding strength between press-down projections 19 and base film 11.

1. Embodied Samples 1 Through 4

Adhesive resin 18 used in the samples for the evaluation of bonding strength is a kind of resin having a main ingredient of urethane acrylate with four levels of hardness ranging between HDD80 and HDD65 at intervals of HDD5 as measured by a type D durometer specified in JIS Standard K-7215 (hereinafter referred to as durometer hardness), after the resin has been cured.

For this evaluation, tests were conducted on specially made samples provided with round dome-like movable contacts 14 having 4 mm in outer diameter, and press-down projections 19 having five different outer diameters ranging from 0.5 mm to 2.5 mm at intervals of 0.5 mm.

2. Related Art Samples

Equivalent tests were carried out on separately prepared samples of the related art, which employ epoxy acrylate resin with durometer hardness of HDD80 as adhesive resin 5B, and provided with same movable contacts 14 and press-down projections 19 as those of the embodied samples.

Test 1. Measurement of Bonding Strength

Figure 4:
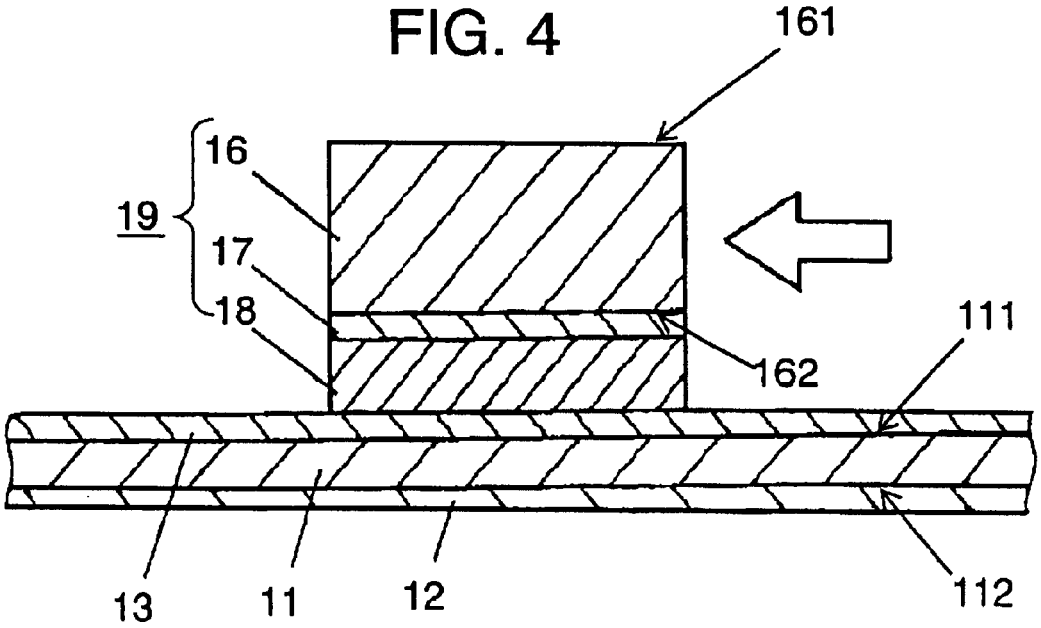
FIG. 4 is a drawing illustrating a method of measuring bonding strength of the press-down projections of the movable contact unit according to the exemplary embodiment of this invention.

The samples prepared for measurement of bonding strength are as shown in FIG. 4. Movable contacts 14 and separator 15 placed on base film 11 were removed from each sample of movable contact units 100 described in the above exemplary embodiment. In addition, the convexed portions in the areas where movable contacts 14 were located on base film 11 were flattened, and made the base film into generally a flat plate-like shape. After the above preparation, a shearing load was applied in a direction indicated by an arrow in FIG. 4 on the side of small cylindrical part 16 bonded to first film surface 111 of each sample, and a strength of the bonding was measured when press-down projection 19 came off.

The results are shown in Table 1.

TABLE 1

| Dia. of Press-down Projection | Bonding Strength: Related art Samples Hardness: HDD80 | | Embodied Samples 1 Hardness: HDD80 | | Embodied Samples 2 Hardness: HDD75 | | Embodied Samples 3 Hardness: HDD70 | | Embodied Samples 4 Hardness: HDD65 | |
|---|---|---|---|---|---|---|---|---|---|---|
| | Bonding strength | Judge-ment | Bonding strength | Judge-ment | Bonding strength | Judge-ment | Bonding strength | Judge-ment | Bonding strength | Judje-ment |
| 0.5 mm | 9 | X | 9 | X | 9 | X | 7 | X | 5 | X |
| 1.0 mm | 13 | O | 19 | O | 16 | O | 14 | O | 10 | O |
| 1.5 mm | 18 | O | 26 | O | 23 | O | 21 | O | 20 | O |
| 2.0 mm | 23 | O | 34 | O | 31 | O | 28 | O | 25 | O |
| 2.5 mm | 28 | O | 39 | O | 37 | O | 35 | O | 31 | O |

(Unit of bonding strength: N)

Since the desired bonding strength is 10 N (Newtons) or greater as required for the practical application, a mark "O" is used in the above table when the bonding strength is 10 N or greater, and another mark "X" when the strength is less than 10 N.

Figure 7:
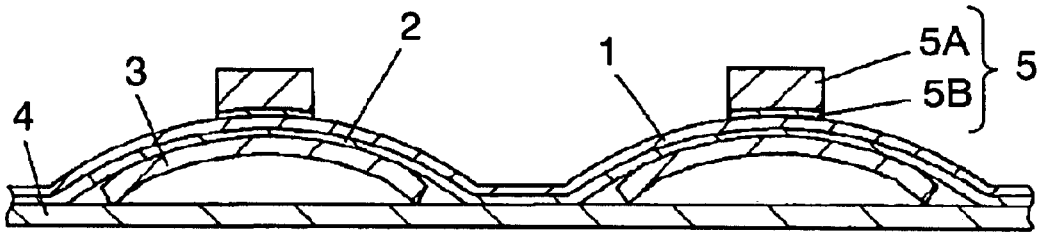
FIG. 7 is a sectioned front view of a movable contact unit of the related art.
Figure 8:
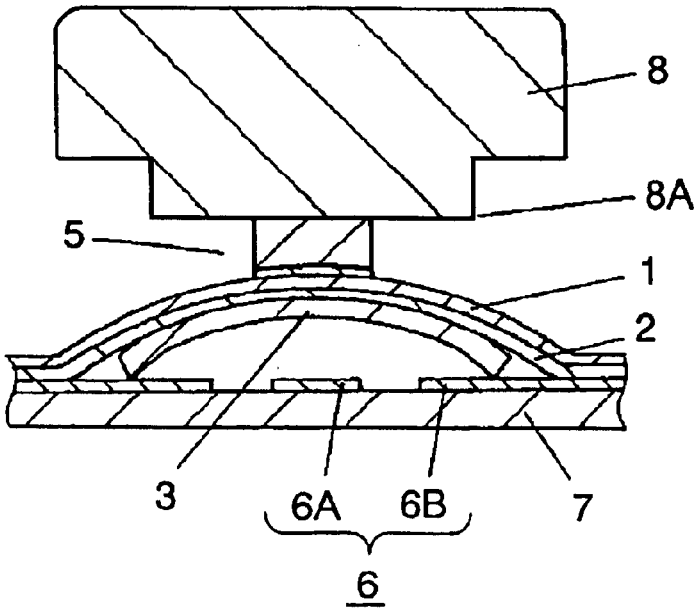
FIG. 8 is a sectioned view of a portion of a control panel switch provided with the movable contact unit of the related art.
Figure 9:
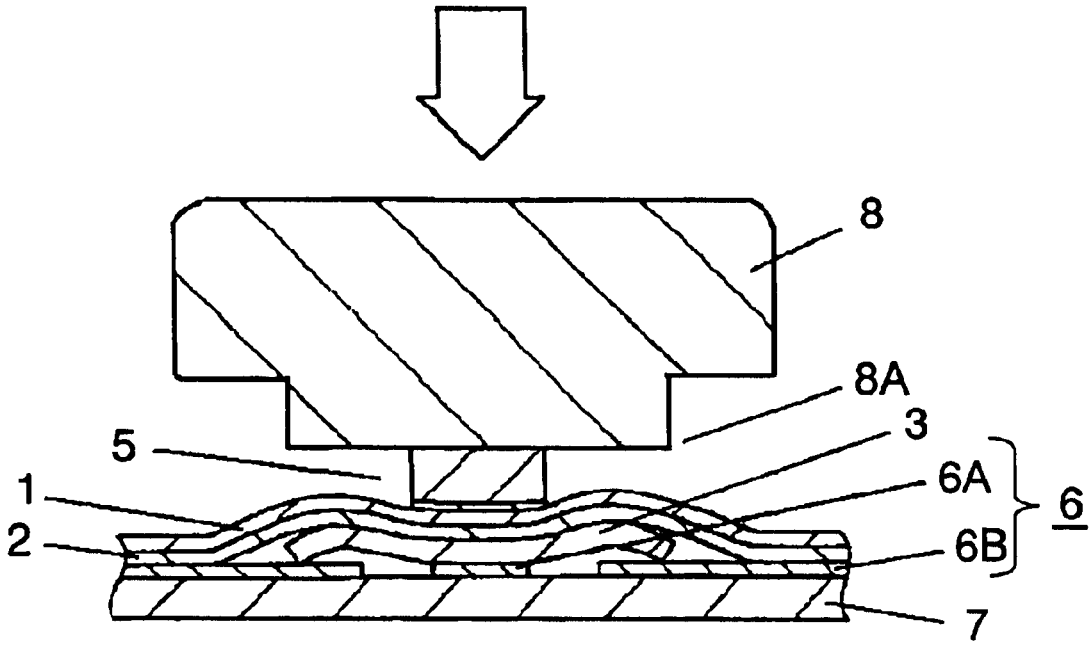
FIG. 9 is a drawing illustrating operation of the control panel switch of the related art.

Upon examination of the individual tested samples, it was confirmed initially that press-down projections 5 had been torn off between the surfaces of base films 1 and adhesive resins 5B shown in FIG. 7 in the related art samples. It was thus considered that the bonding strength depends on the adhesion between those components.

On the other hand, the embodied samples 1 through 4 showed that press-down projections 19 have been torn off together with base films 11 at the areas where the projections 19 are bonded.

This result indicates strong adhesion between base films 11 made of PET and first pretreated layers 13 formed of coated Ester resin, as well as cylindrical parts 16 and second pretreated layers 17, and also strong adhesion between first pretreated layers 13 and UV-cured adhesive resin 18 composed of urethane acrylate or between second pretreated layers 17 and the UV-cured adhesive resin 18.

First pretreated layers 13 and second pretreated layers 17 formed of Ester resin, when provided in the above manner, improve wettability of base films 11 made of PET and cylindrical parts (i.e. press-down members) 16 to the adhesive resin, thereby providing the strong bonding therebetween.

As shown in Table 1, the embodied samples 1 through 4 have comparatively higher bonding strength than the related art samples, except for the one having press-down projections 19 of 0.5 mm in the outer diameter, and the higher the durometer hardness of adhesive resin 18, the greater the bonding strength obtained by it. It was determined here that adhesive resin 18 gets better adhesion to base film 11 the greater the hardness of it becomes after cured by the ultraviolet rays.

However, the embodied samples 3 and 4 were not superior in strength than the related art samples when outer diameters of their press-down projections 19 were 0.5 mm or less and 1.0 mm or less respectively. In consideration of the torn-off conditions, it was determined that press-down projections 19 in the diameter of 1.0 mm can satisfy the standard value (i.e. 10 N or greater in the bonding strength), and have durability equal to or greater than the related art devices even when unevenness of the adhesive and the like are taken into account.

Furthermore, the results showed lack of the bonding strength even on the embodied samples 1 through 3 having adhesive resin 18 of durometer hardness HDD80 to 70 when press-down projections 19 were 0.5 mm in diameter, although they had sufficient strength when the diameter was 1.0 mm to 2.5 mm.

The related art samples also showed similar results. In consideration of the fact that movable contacts 14 are 4 mm in outer diameter, and according to the above test results, it was confirmed desirable that press-down projections 19 have a diameter equal to or larger than ¼ of the diameter of movable contacts 14. Likewise, press-down projections 19 may have a surface area equal to or larger than 1/16 of the movable contacts 14 because they are ¼ in the outer diameter.

Test 2. Evaluation of Tactile Response

Next, same samples as the embodied samples 3 were used for depressing operation, and their tactile responses were evaluated by comparison.

Table 2 shows the results. A mark "0" is used for a sample exhibiting good tactile response and another mark "X" for any sample exhibiting poor tactile response in Table 2.

TABLE 2

| Diameter of Press-down Projection | Tactile Response to Operation: Related art Samples Hardness: HDD80 Judgment | Embodied Samples 3 Hardness: HDD70 Judgment |
|---|---|---|
| 0.5 mm | O | O |
| 1.0 mm | O | O |
| 1.5 mm | O | O |
| 2.0 mm | O | O |
| 2.5 mm | X | X |

Marks for judgment: "O" denotes good tactile response, and "X" denotes poor tactile response.

As shown in Table 2, both the related art samples and the embodied samples 3 exhibited the same result of tactile response to the depressing operation. In other words, the samples having press-down projections 19 ranging from 0.5 mm to 2.0 mm in outer diameter gave excellent click feelings, and the samples having 2.5 mm diameter gave poor click feelings.

These poor tactile responses are considered attributable to the outer diameter of press-down projection 19 bonded to round dome-like movable contact 14, in that the diameter of press-down projection 19, if made closer to the outer diameter of movable contact 14, overlies near the rounded surface of movable contact 14, which impedes the springy click motion of the dome-like movable contact 14 although it is still inflective.

The above results also showed that the tendency of changes in the tactile response is not dependent upon presence or absence of the coating of Ester resin serving the pretreated layer, or properties of the UV-curable resin material, but it depends only on size of press-down projection 19. In other words, the same results were obtained on the samples irrespective of kind of the UV-curable resin, between Urethane material and epoxy-base material.

According to the above result of examination on the tactile response, it was found that press-down projections 19 of ½ or less in diameter of the movable contacts 14 is desirable. It is therefore desirable that press-down projections 19 have a relative surface area of ¼ or less to movable contacts 14.

Test 3. Durability Test

As an evaluation of durability, test was carried out next on the bonding strength with respect to number of depressing operations.

Test Method

First, separator 15 was peeled off, and the movable contact unit having the press-down projections was placed on wiring board 7, to compose a panel switch as shown in FIG. 2. Next, samples of the switch were operated by depressing and releasing press-down projections 19 from the direction shown by an arrow in FIG. 3 with a thrusting force of 3 N. The operation was repeated by counting each inflection and restoration of movable contact 14 as one cycle. On the other hand, bonding strengths were measured by the method described previously with reference to FIG. 4, at the start of testing, after completion of operations for 100,000 cycles, 500,000 cycles, 1,000,000 cycles, and 2,000,000 cycles.

Test samples

The tests were performed on samples prepared using press-down projections 19 having an outer diameter of 1.5 mm, and four different types of adhesive resin 18 in the hardness of HDD 80, 75, 70 and 65 (hereinafter designated as embodied samples 5 to 8).

In addition, the same tests were also conducted for the comparison purpose on the related art samples prepared by using press-down projections 19 of 1.5 mm diameter among those samples described above.

Test Result 1

The results are shown in Table 3.

TABLE 3

| Test Samples | Related art samples | Embodied sample 5 | Embodied sample 6 | Embodied sample 7 | Embodied sample 8 |
|---|---|---|---|---|---|
| Coating resin Adhesive resin (UV-curable resin) | None | Ester resin | Ester resin | Ester resin | Ester resin |
| Basic composition Hardness Number of Operations | Epoxy Acrylate HDD80 | Urethane Acrylate HDD80 | Urethane Acrylate HDD75 | Urethane Acrylate HDD70 | Urethane Acrylate HDD65 |
| Start | 18 | 26 | 23 | 21 | 20 |
| 100,000 cycles | 16 | 24 | 21 | 20 | 19 |
| 500,000 cycles | 14 | 17 | 20 | 18 | 18 |
| 1,000,000 cycles | 12 | 13 | 19 | 18 | 17 |
| 2,000,000 cycles | 5 | 10 | 17 | 15 | 15 |

Numerical values represent the bonding strengths (N).

Figure 5:
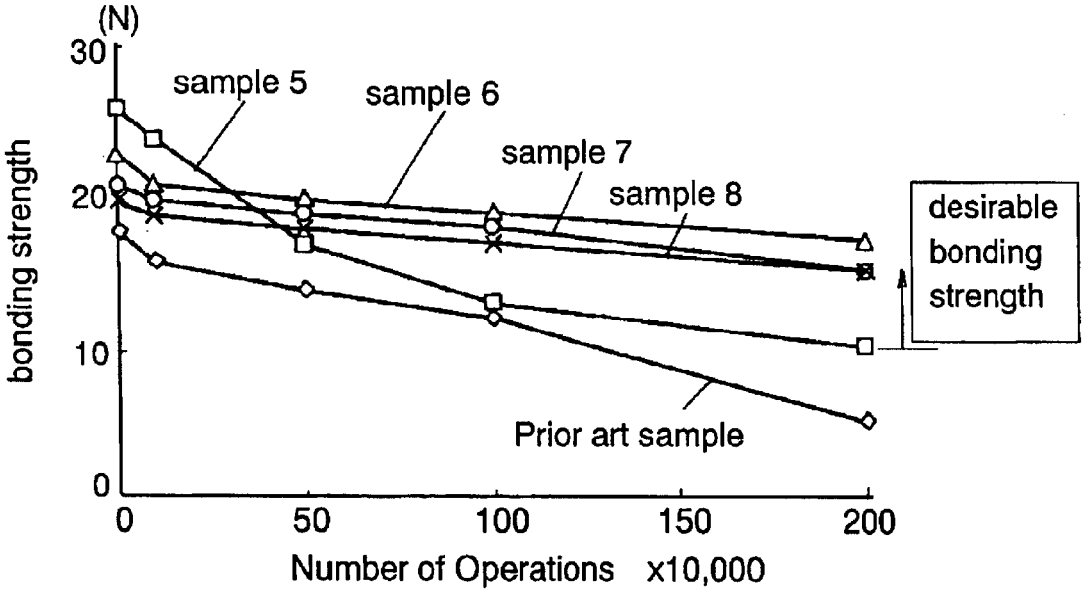
FIG. 5 is a graphical representation showing a test result of the bonding strength corresponding to number of depressing operations.

FIG. 5 is a graphical representation of the results shown in Table 3 for the purpose of easy reference.

As is obvious from Table 3 and FIG. 5, the embodied sample 5 having durometer hardness of HDD80 had the largest initial bonding strength, and they exhibited a tendency of decreasing the bonding strength as the number of operating cycles increases. However, these samples showed better performance on all of the tests up to 2,000,000 cycles as compared to the results of the related art sample.

This tendency of the embodied sample 5 is considered attributable to the excessive stiffness of adhesive resin 18, which makes it difficult to absorb the repeated pressure of inflection and restoration of movable contact 14 caused by the depressing operations, thereby resulting in the decrease of bonding strength.

However, the bonding strength of the embodied sample 5 after the completion of 2,000,000 cycles was 10 N, which remains still within a range of the desirable bonding strength for the practical use.

On the other hand, it was found that the embodied samples 6 through 8 prepared with the adhesive material of HDD75 to 65 in the durometer hardness have high durability, as they maintain bonding strengths higher than 80% of the initial bonding strengths after 1,000,000 cycles of operation, and higher than 70% even after the completion of 2,000,000 cycles of operation.

These results of the embodied samples 6 through 8 seem to be the effects of elasticity provided by the low hardness of adhesive resin 18 composed of urethane acrylate, in that adhesive resin 18 functions as a buffer to absorb the repeated pressure of the depressing operation mentioned above.

Test Result 2

Further tests were performed to evaluate the bonding strength under the high temperature and high humidity environment. Those tests were carried out since the elasticity of adhesive resin 18 might be obtained owing to the porous structure of the material or might show high moisture permeability.

Similar tests were conducted and measurement results of bonding strength against the number of operations were recorded on samples prepared in the same manner as the embodied samples 5 through 8 as well as the related art samples corresponding to them.

Bonding strengths were measured after the test samples were subjected to the 100,000 cycles of depressing operation under an environment of 60° C. in temperature and 90 to 95%-RH in humidity as the test condition.

Figure 6:
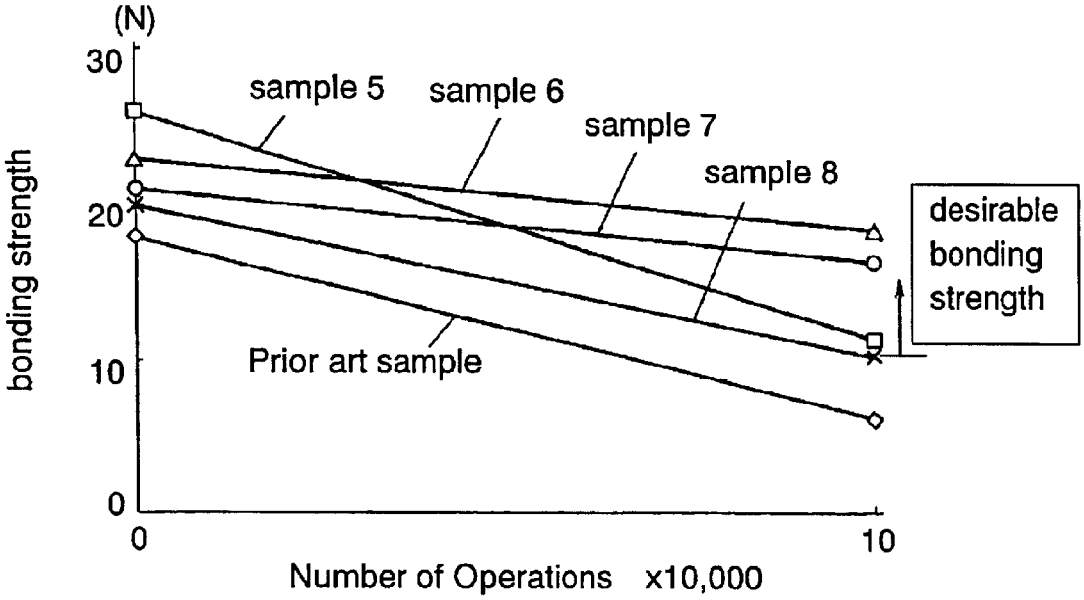
FIG. 6 is a graphical representation showing another test result of the bonding strength corresponding to number of depressing operations under high temperature and high humidity environment.

The results are shown in Table 4 and a graph in FIG. 6.

TABLE 4

| Sample | Related art sample | Embodied sample 5 | Embodied sample 6 | Embodied sample 7 | Embodied sample 8 |
|---|---|---|---|---|---|
| Coating resin Adhesive resin (UV-curable resin) | None | Ester resin | Ester resin | Ester resin | Ester resin |
| Basic composition Hardness Number of Operations | Epoxy Acrylate HDD80 | Urethane Acrylate HDD80 | Urethane Acrylate HDD75 | Urethane Acrylate HDD70 | Urethane Acrylate HDD65 |
| Start | 18 | 26 | 23 | 21 | 20 |
| 100,000 cycles | 6 | 11 | 18 | 16 | 10 |

Numerical values represent the bonding strengths (N).

As is obvious from Table 4 and FIG. 6, it was confirmed that all of the embodied samples 5 through 8 maintain high levels of bonding strength in absolute value as compared with the related art sample, although the embodied samples 8 and 5 show a tendency of decrease in the relative bonding strength similar to that of the related art sample.

The reduction in strength of the embodied sample 8 is thought to be due to an increase in hygroscopic property of adhesive resin 19 as it might be formed into a porous structure or a dynamic structure with elasticity, as discussed above. The reduction in strength of the embodied sample 5 is thought to be due to the stiffness of cured adhesive resin 19, as was seen in the previous test on the bonding strength to the number of operations.

The embodied samples 6 and 7 have very high durability, as they maintain bonding strengths higher than 75% of the initial bonding strengths even after the test.

According to the confirmation tests for the bonding strengths of press-down projections 19 to base film 11, as discussed above, it was verified that the invention can strengthen the bonding strengths while maintaining the excellent durability by the above structure, in which base film 11 made of PET having round dome-like movable contacts 14 is provided with first pretreated layer 13 formed of coated Ester resin on it upper surface, small cylindrical parts 16 made of PET and constituting press-down projections 19 are each provided with second pretreated layer 17 also formed of coated Ester resin on the underside surface, and base film 11 and press-down projections 19 are bonded together via these pretreated layers.

In addition, the productivity can be improved to make the movable contact unit less expensive when UV-curable urethane acrylate resin is used as adhesive resin 18, since it has fast curing reaction.

Furthermore, adhesive resin 18 can be formed with optimum elasticity when its hardness is maintained within the range of HDD80 and 65 in the durometer hardness, so as to make it function as a buffer to the force applied during repeated depressing operation, and thereby improving the durability in addition to the bonding strength.

Like advantages can also be expected even when other types of adhesive resin are used so long as the hardness is maintained to the same range of HDD80 and 65 in the durometer hardness, so as to provide the optimum elasticity as the adhesive resin with buffering function.

Press-down projections 19 can provide excellent and stable operational response when their outer diameter is designed to be ¼ to ½ the outer diameter of the round dome-like movable contacts 14. This can provide a large area of adhesion for press-down projections 19 to ensure strong adhesion and to maintain the adhesion steady for a prolonged duration. A ratio of the surface area of adhesion between 1/16 and ¼ is thus suitable.

However, outer diameter of press-down projections 19 between ⅜ and ½ of the outer diameter of dome-like movable contacts 14 is rather desirable, if adhesive resin 18 used is an UV-curable urethane acrylate resin having HDD65 in the durometer hardness. A desirable relative surface area in this case is between 9/64 and ¼.

In this exemplary embodiment, although what has been described is an example in which pretreated layers are formed by coating Ester resin, this is not restrictive and that the pretreated layers can be formed by coating Urethane resin. The coating of Urethane resin can also improve wettability with the adjoining resin. In addition, use of the above-said urethane acrylate resin as adhesive to form adhesive resin 18 can further improve adhesion between the preprocessing layers and adhesive resin 18 since they are the same type of material.

According to this exemplary embodiment, what has been discussed is the structure in which pretreated layers formed of coated Ester resin or Urethane resin are provided on the surfaces of the press-down projections and the base film that come to contact with each other, and these pretreated layers are bonded with UV-curable urethane acrylate resin. This structure improves the wettability between the pretreated layers and the adhesive to strengthen their adhesion, and achieves the movable contact unit having press-down projections that can keep the adhesion for a long duration.

As discussed, the present invention has an outstanding advantage of providing the highly reliable movable contact unit having press-down projections which can maintain the press-down projections in a securely bonded condition to the base film without increasing a number of components used and necessitating a complicated manufacturing process.

What is claimed is:

1. A movable contact unit having press-down projections comprising:

base film having first film surface and second film surface;

adhesive layer covering said first film surface;

first pretreated layer covering said second film surface;

a plurality of dome-like movable contacts with outer surfaces held adhered to said adhesive layer;

a plurality of press-down members, each having upper surface and underside surface; and second pretreated layer covering said underside surface, wherein said second pretreated layer is bonded to said first pretreated layer with adhesive in a position where each said press-down members confronts a center portion of each said movable contacts.

2. The movable contact unit of claim 1, wherein at least one of said first pretreated layer and said second pretreated layer is a resin layer comprising a coating of any of Urethane resin and Ester resin.

3. The movable contact unit of claim 1, wherein said adhesive comprises UV-curable adhesive resin.

4. The movable contact unit of claim 3, wherein said adhesive resin comprises urethane acrylate.

5. The movable contact unit of claim 3, wherein said adhesive has an after-cured hardness of HDD 80 to 65 as measured by a type D durometer according to JIS Standard K 7215.

6. The movable contact unit of claim 1, wherein an underside surface of each said press-down members has an outer diameter between ¼ and ½ of an outer diameter of said movable contacts.

7. The movable contact unit of claim 1, wherein an underside surface of each said press-down members has a surface area between 1/16 to ¼ of a surface area of said movable contacts.

8. The movable contact unit of claim 1, wherein said first pretreated layer provides said basefile with good wettability to said adhesive, and said second pretreated layer provides said press-down members with good wettability to said adhesive.

9. The movable contact unit of claim 1, wherein said first pretreated layer improves adhesion between said basefile and said adhesive, and said second pretreated layer improves adhesion between said press-down members and said adhesive.

* * * * *